US010589443B2

(12) United States Patent
Hauber et al.

(10) Patent No.: US 10,589,443 B2
(45) Date of Patent: Mar. 17, 2020

(54) APPARATUS AND METHOD FOR CONSTRUCTING BUILDING BOARDS USING LOW FRICTION SURFACES

(71) Applicant: Saint-Gobain Placo SAS, Suresnes (FR)

(72) Inventors: Robert J. Hauber, Lutz, FL (US); Gerald D. Boydston, Cody, WY (US); Nathan Gregory Frailey, Tampa, FL (US); Michael P. Fahey, St. Petersburg, FL (US); Bryan J. Wiltzius, Largo, FL (US); John M. Bridenstine, Dade City, FL (US)

(73) Assignee: SAINT-GOBAIN PLACO SAS, Suresnes (FR)

( * ) Notice: Subject to any disclaimer, the term of this patent is extended or adjusted under 35 U.S.C. 154(b) by 0 days.

(21) Appl. No.: 15/827,142

(22) Filed: Nov. 30, 2017

(65) Prior Publication Data

US 2018/0079106 A1 Mar. 22, 2018

Related U.S. Application Data

(63) Continuation of application No. 14/153,156, filed on Jan. 13, 2014, now abandoned.

(51) Int. Cl.
*B28B 19/00* (2006.01)
*E04C 2/04* (2006.01)
(Continued)

(52) U.S. Cl.
CPC ..... *B28B 19/0092* (2013.01); *B05D 1/02* (2013.01); *B05D 1/26* (2013.01); *B28B 1/32* (2013.01); *B28B 19/0015* (2013.01); *B65H 20/14* (2013.01); *B65H 23/24* (2013.01); *B65H 29/24* (2013.01); *B65H 29/686* (2013.01); *E04C 2/043* (2013.01); *E04C 2/044* (2013.01);
(Continued)

(58) Field of Classification Search
CPC ..... B28B 19/0092; B28B 19/0015; B28B 19/002; B65H 23/24; B65H 2701/177; B65H 2406/1132; B65H 2406/112; B65H 20/14; B65H 29/24; B65H 29/686; E04C 2/043; E04C 2/044; B32B 1/32; B32B 19/0015; B32B 19/0092; B05D 1/02; B05D 1/26; B05D 2203/22; B05D 2252/02
See application file for complete search history.

(56) References Cited

U.S. PATENT DOCUMENTS 1,749,436 A 3/1930 Meier
2,176,307 A 10/1939 Lamb et al.
(Continued)

FOREIGN PATENT DOCUMENTS

EP 0684757 A1 11/1995
GB 2243817 A 11/1991

*Primary Examiner* — William P Fletcher, III
(74) *Attorney, Agent, or Firm* — McDonnell Boehnen Hulbert & Berghoff LLP

(57) ABSTRACT

A method for producing building boards includes unwinding a facing sheet from a supply roll of facing sheet over top of a forming table that includes a series of nozzles. A volume of cementitious material is deposited from a slurry mixing device to the unwound facing sheet. Pressurized air is supplied from an air source to the series of nozzles, whereby a cushion of air is created between the unwound facing sheet and the forming table.

16 Claims, 5 Drawing Sheets

(51) Int. Cl.

| | |
|---|---|
| ***B65H 23/24*** | (2006.01) |
| ***B05D 1/02*** | (2006.01) |
| ***B05D 1/26*** | (2006.01) |
| ***B65H 29/24*** | (2006.01) |
| ***B28B 1/32*** | (2006.01) |
| ***B65H 29/68*** | (2006.01) |
| ***B65H 20/14*** | (2006.01) |

(52) U.S. Cl.
CPC ..... *B05D 2203/22* (2013.01); *B05D 2252/02* (2013.01); *B65H 2406/112* (2013.01); *B65H 2406/1132* (2013.01); *B65H 2701/177* (2013.01)

(56) References Cited

U.S. PATENT DOCUMENTS 2,517,388 A 8/1950 Daves
2,722,262 A 11/1955 Eaton et al.
2,848,820 A 8/1958 Werner et al.
3,529,357 A 9/1970 Schuette et al.
4,131,320 A * 12/1978 Volat ..... B65G 51/03 406/88
4,136,214 A * 1/1979 Bourelier ..... B29C 48/9145 427/169
4,141,457 A 2/1979 Nocek
4,280,782 A 7/1981 Stumpf
4,298,413 A 11/1981 Teare
4,462,720 A 7/1984 Lenhart
5,143,509 A 9/1992 Focke
5,342,566 A * 8/1994 Schafer ..... B28B 1/525 264/102
6,221,521 B1 * 4/2001 Lynn ..... B32B 13/02 428/703
6,336,775 B1 1/2002 Morita et al.
7,223,060 B2 5/2007 Weidenmuller
7,393,159 B2 7/2008 Chang et al.
7,530,778 B2 5/2009 Yassour et al.
RE41,592 E 8/2010 Lynn et al.
2002/0069950 A1 * 6/2002 Lynn ..... B28B 1/522 156/41
2002/0191993 A1 * 12/2002 Bartscher ..... B65H 5/38 399/320
2006/0239808 A1 * 10/2006 Ludwig ..... B65G 47/24 414/676
2009/0297865 A1 * 12/2009 Hauber ..... B28B 7/0079 428/432

* cited by examiner

APPARATUS AND METHOD FOR CONSTRUCTING BUILDING BOARDS USING LOW FRICTION SURFACES

CROSS-REFERENCE TO RELATED APPLICATION

This is a continuation of application Ser. No. 14/153,156, filed Jan. 13, 2014, which is hereby incorporated by reference in its entirety.

TECHNICAL FIELD

This disclosure relates to an apparatus and method for constructing building boards. More specifically, the present disclosure relates to a building board forming line that utilizes pressurized air to reduce associated frictional forces.

BACKGROUND OF THE INVENTION

There are a variety of know processes for constructing building boards. One known method employs a forming line consisting of one or more forming tables. The building board, which may be a gypsum based building board, is sequentially assembled over the forming tables. A roll of a facing material, such as paper or a fibrous bounds mat, is unwound over the first forming table to form the lower surface of the board. The forming tables may include rotatable belts to transport the facing material. An overhead mixer is included for depositing a volume of cementitious slurry upon the inner surface of the facing material. An additional roll is included for providing an opposing facing material.

These known methods suffer from several disadvantages. For example, the friction between the facing material and the forming table often damages or mars the resulting budding board. This may result in the board being unsuitable for its intended use. Furthermore, known manufacturing techniques often result in an uneven distribution of cementitious slurry during formation. Most often the slurry disproportionally accumulates along the center line of the board, closest to the outlet of the overhead mixer. As a result, the edges of the resulting board are insufficiently strong and are prone to chipping or disintegration.

Over the years, various devices have been created for improving the board manufacturing process. For example, U.S. Pat. No. 2,722,262 to Eaton discloses an apparatus for the continuous production of a paper encased gypsum plaster strip. The apparatus includes a table over which a continuous strip is passed. The apparatus further includes a block and side guide members for shaping the strip and associated gypsum.

U.S. Pat. No. 3,529,357 to Hune et al. discloses method and apparatus for the high-speed drying of gypsum boards. The apparatus includes jet nozzles that impinge heated air on the this edge portions of the materials throughout a drying process.

Yet another manufacturing method is disclosed by U.S. Pat. No. 5,342,566 to Schafer et al. Schafer discloses a method and apparatus using air jets to support a gypsum board prior to cutting. The air cushion provides a lifting force but does not impart any forward motion.

U.S. Pat. No. 4,298,413 to Teare discloses method for producing fabric-reinforced thin concrete panels that are suitable as backer board for construction materials. Constructed panels can be transferred in seriatim to an air-float stacking unit positioned over a stacking table.

Finally, U.S. RE 41,592 to Lynn et al. discloses a manufacturing method for producing gypsum/fiber board with improved impact resistance. The method utilizes airjets to support the gypsum fiber board during processing.

Although the aforementioned methods each achieve their own unique objectives, all suffer from common drawbacks. The devices and methods described herein are designed to overcome the shortcomings present in background art. In particular, the devices and methods described herein employ pressurized air for the purpose of transporting building boards, ensuring adequate slurry spread, and/or preventing the boards from being damaged or marred during manufacture.

SUMMARY OF THE INVENTION

This disclosure permits smooth exterior finishes to be applied to wall boards with minimal finishing materials, time, and expense.

It is therefore one of the objectives of this invention to provide a gypsum board forming device that promotes the uniform distribution of slurry adjacent a pinch point.

It is yet another objective of this invention to provide a gypsum board forming device the promotes the spread of slurry to the edges of an associated forming table.

Various embodiments of the invention may have none, some, or all of these advantages. Other technical advantages of the present invention will be readily apparent to one skilled in the art.

BRIEF DESCRIPTION OF THE DRAWINGS

For a more complete understanding of the present disclosure and its advantages, reference is now made to the following descriptions, taken in conjunction with the accompanying drawings, in which.

DETAILED DESCRIPTION OF THE DRAWINGS

The present disclosure relates to a board forming device that employs pressurized air to reduce the friction between the board and the underlying forming tables. The device employs a series of air nozzles that are formed within the face of the forming tables. An air source delivers pressurized air to the nozzles. As completed or partially completed boards travel along the forming tables, an air cushion is created to reduce the friction between the board and the underlying table. The pressurized air can also be used to transport the boards and promote the even distribution of slurry during formation. The various components of the present invention, and the manner in which they interrelate, are described in greater detail hereinafter.

Figure 1:
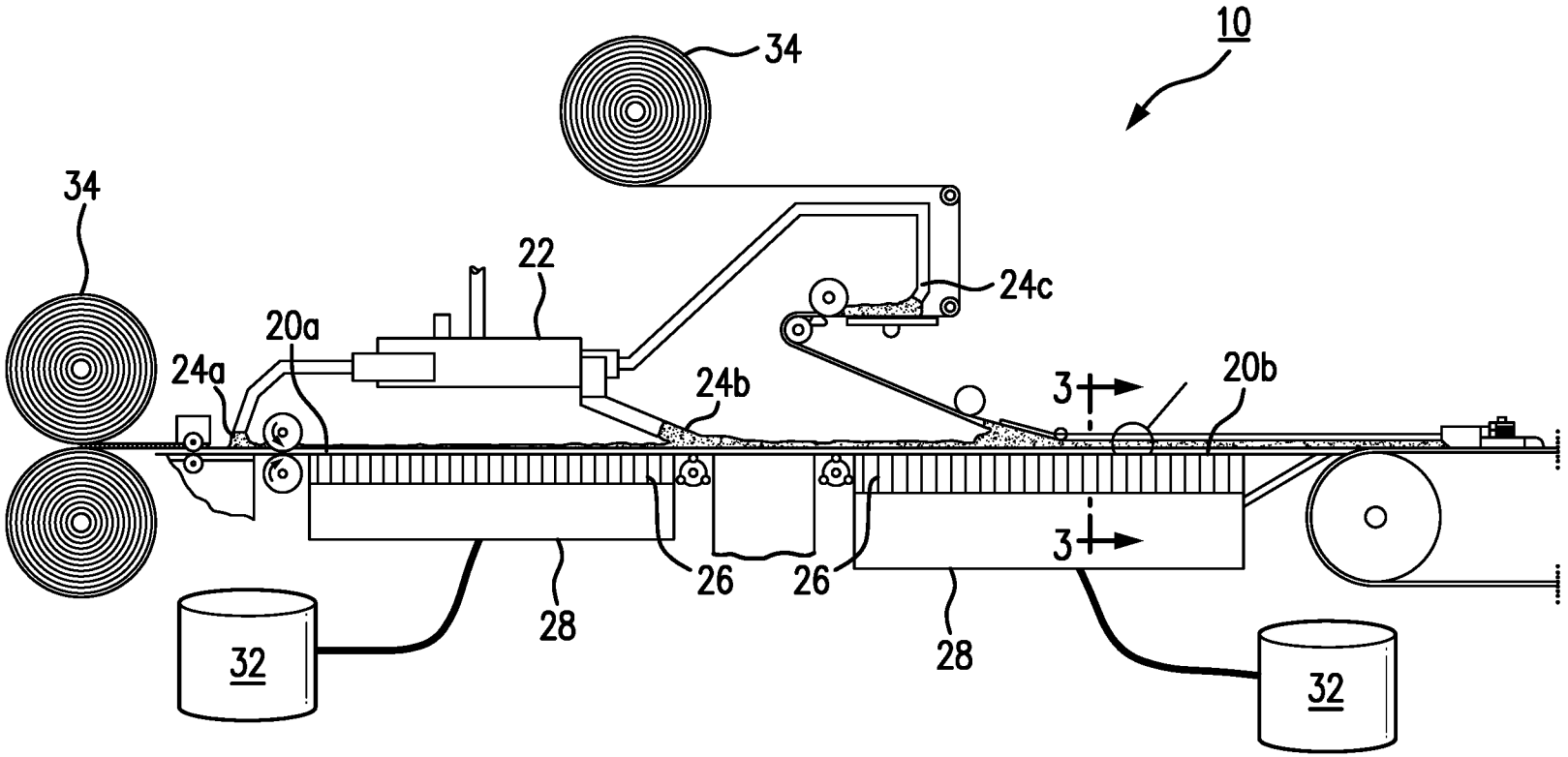
FIG. 1 is a side elevational view of a production line for producing building boards in accordance with the present disclosure.

With reference now to FIG. 1, a board forming line 10 is accordance with the present disclosure is illustrated. Line 10 assembles building boards 18 along a series of forming tables (20*a* and 20*b*) by way of an overhead slurry mixer 22. Mixer 22 includes a series of outlets (24*a*, 24*b*, and 24*c*) for supplying slurry at different locations long line 10. Mixer 22 can also supply slurry at varying densities and/or consistencies. As illustrated, the first and second outlets (24*a* and 24*b*) deposit slurry at two different locations along the first forming table 20. Third outlet 24*c* deposits slurry at a third location long the second forming table 20*b*. This configuration is provided only as a representative example, and other configurations for the forming line will readily be appreciated by those of ordinary skill in the art.

In accordance with the invention, each forming table 20 includes a series of nozzles 26 within its upper face. Nozzles 26 can be perforations, orifices, ports, or other openings formed within the surface of tables 20*a* and 20*b*. The nozzles 26 can have a minimum open diameter of 0.001 to a maximum open diameter of 0.0250 inches. The associated airflow rate will have a minimum velocity of 1 scfm (standard cubic feet per minute) to a maximum velocity of 490 scfm per a running foot of equipment. The minimum ported or air escape wall thickness of the air supply manifold shall be no less than 0.002 inches and no greater than 1.500 inches.

In one embodiment, tables 20 are elongated belts that rotate about pulleys for use in transporting the board 18 during assembly. In this case, nozzles 26 are formed within the upper surface of the belt. In yet another embodiment, tables (20*a* and 20*b*) are stationary and board 18 is transported via a directed air cushion supplied by nozzles 26.

With continuing reference to FIG. 1, it can be seen that an air plenum chamber 28 is associated with each of the forming tables 20*a* and 20*b*. Each plenum 28 has a similar construction and only one is described in detail. Plenum 28 is designed to accumulate pressurized air for delivery to nozzles 26 within forming table 20. As such, each plenum 28 is in fluid communication with both the nozzles 26 and an air source 32. In the depicted forming line, two separate air sources 32 are provided for each of the two plenums 28. However, other configurations are within the scope of the present disclosure. For example, a single plenum 28 can be provided along one or more forming tables 20. Additionally, a single air source 32 can be provided for multiple plenums 28.

A supply roll 34 is included at a first end of forming line 10. Roll 34 supplies the bottom facing sheet 36 to forming table 20. Facing sheet 36 can be formed from a number of different materials. For example, facing sheet 36 can be formed form paper or from a fibrous mat. In either event, facing sheet 36 is delivered over the top of the first forming table 20*a*. In the event a belt is included, facing sheet 36 is transported via movement of the belt. Slurry mixer 22 deposits slurry upon the exposed surface of facing sheet 36 as it is transported along forming line 10.

Air supply 32 supplies pressurized air to each of the nozzles 26 such that a cushion of air "C" (note FIG. 4) is formed between the bottom surface of facing sheet 36 and upper surface of table 20. Air cushion C reduces the coefficient of friction between the facing sheet 36 and table 20 as board 18 is transported along forming line 10. As described below, nozzles 26 can be orientated to transport board 18 along line 10.

Figure 2:
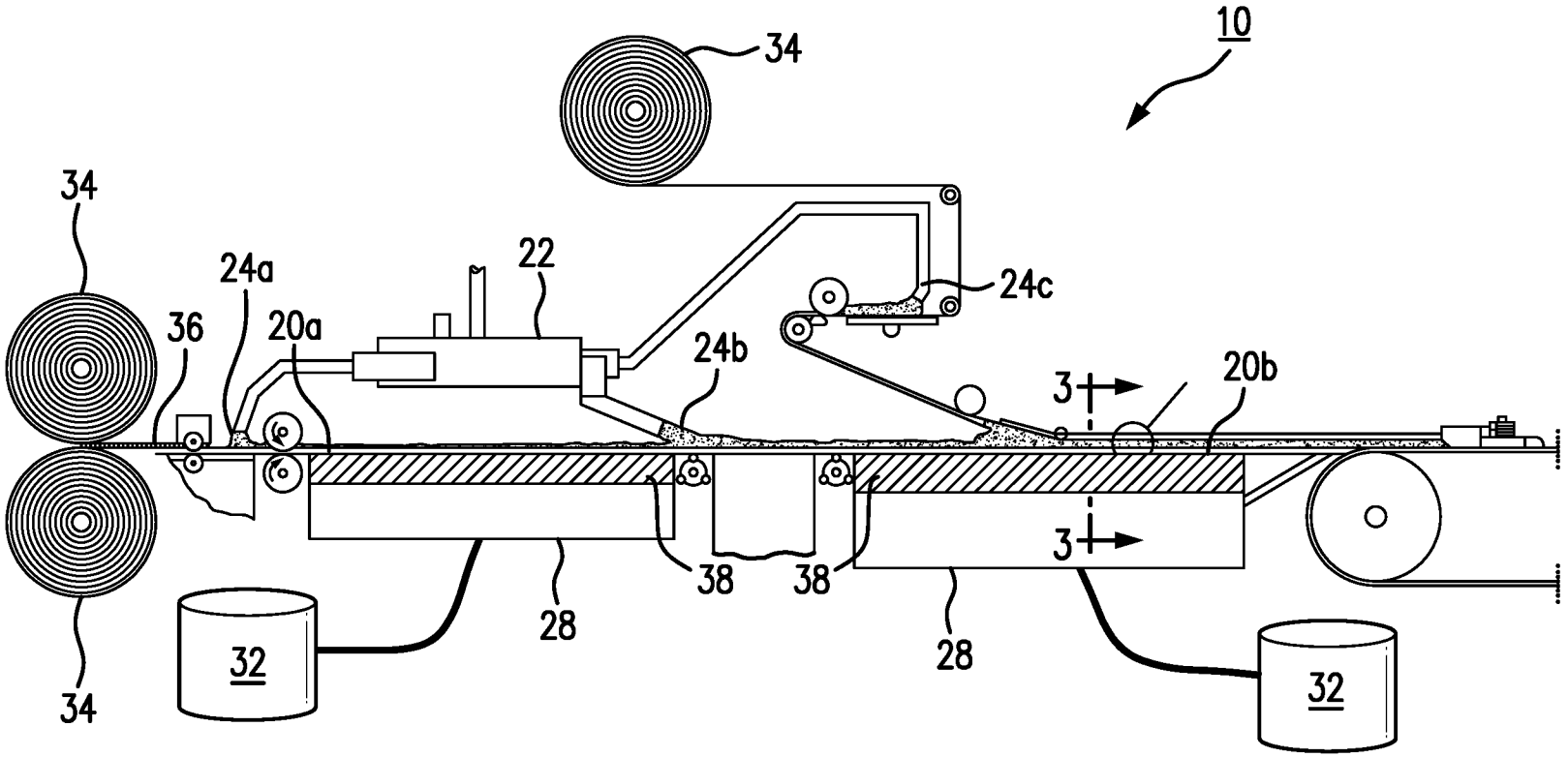
FIG. 2 is a side elevational view of an alternative production line for producing building boards in accordance with the present disclosure.

In the embodiment of FIG. 1, the nozzles 26 are evenly distributed across the length and width of the forming tables 20. Additionally, the longitudinal axis of each nozzle 26 is oriented perpendicularly to the face of the forming tables 20. In the embodiment of FIG. 2, angled nozzles 38 are used. Namely, each nozzle 38 is angled in relation to the upper surface of the forming tables 20. The longitudinal axis of each nozzle 38 is positioned at an angle with respect to the surface of forming table 20. As such, the pressurized air is delivered in a direction that corresponds with the movement of board 18 along the forming line 10. The angle of nozzles 38 and the pressurization from source 32 can be optimized to transport board 18 along the length of the forming table 20. This would eliminate the need for the belts, pulleys, and motors that are currently employed in transporting boards. Alternatively, angled nozzles 38 can be formed within the surface of the belts such that nozzles 38 are used in conjunction with the belts in transporting board 18.

Figure 3:
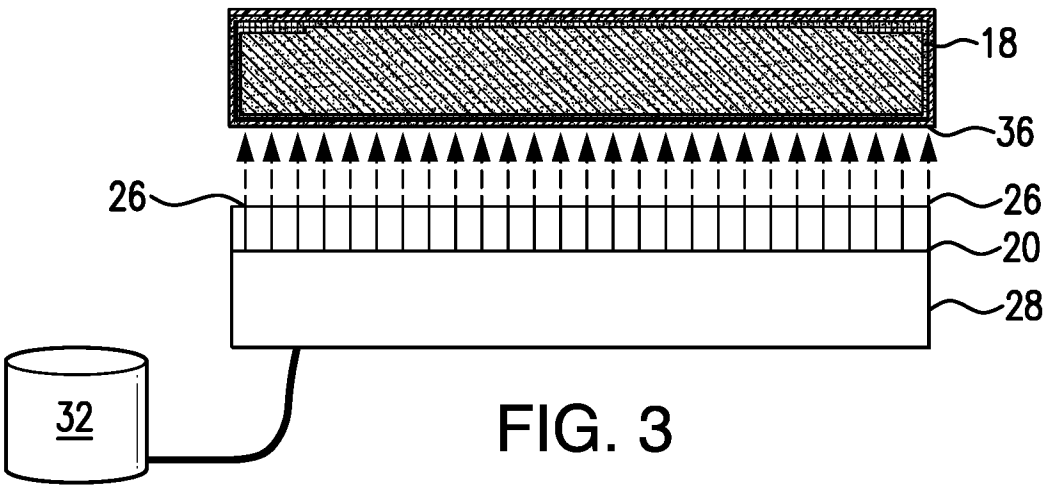
FIG. 3 is a cross sectional view of an air plenum in accordance with the present disclosure.
Figure 4:
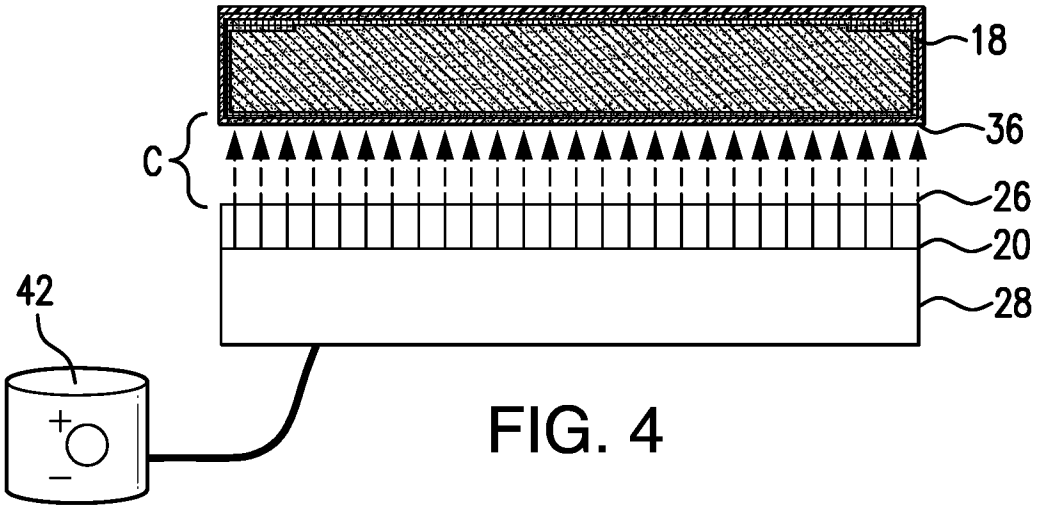
FIG. 4 is a cross sectional view of an air plenum in accordance with the present disclosure.

FIG. 3 is a front elevational view of the board forming line and shows the plenum 28, air source 32, and nozzles 26. This figure illustrates that nozzles 26 can be evenly distributed across the width of table 20. Furthermore, air source 32 delivers air at a uniform and consistent pressure across the width of table 20. The embodiment of FIG. 4 is the same in most respects to embodiment of FIG. 3. However, the air source 42 in FIG. 4 is designed to provide air in pressurized bursts. In other words, air is supplied at intervals and at a set frequency. This can be accomplished via a rotary orifice. This embodiment has the benefit of vibrating the bottom facing sheet 36 and the deposited slurry during board formation. This, in turn, promotes the distribution of the slurry and eliminates unwanted air pockets. It also can ensure that the facing sheet 36, to the extent it is a fibrous mat, becomes partially embedded within the slurry.

Figure 5:
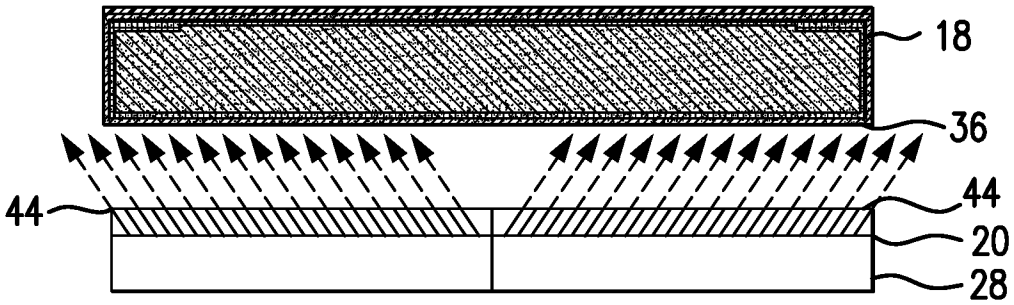
FIG. 5 is a cross sectional view of an air plenum in accordance with the present disclosure.

FIG. 5 illustrates an alternative arrangement of angled nozzles 44. More specifically, the longitudinal axis of each nozzle 44 is again angled with respect to the surface of forming table 20. In this case, however, nozzles are angled outwardly toward the peripheral edges of table 20. Furthermore, nozzles 44 within the first half of the table are oriented opposite to nozzles 44 in the second half of the table. The first and second halves are referenced with respect to a longitudinal axis bisecting table 20. This embodiment is advantageous in promoting the spread of the deposited slurry to the outer peripheral edges of the board.

Figure 6:
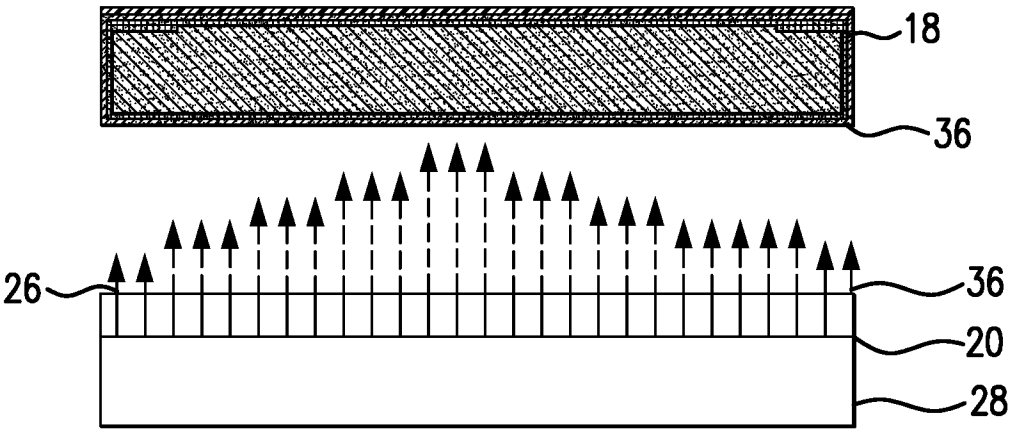
FIG. 6 is a cross sectional view of an air plenum in accordance with the present disclosure.

FIG. 6 illustrates yet another embodiment wherein different pressures are supplied to different areas along the width of forming table 20. More specifically, an air source 32 can deliver highly pressurized air to the nozzles proximate to the longitudinal axis of table 20. Different air sources 32 can deliver air at progressively lesser pressures to the peripheral extents of the board. By delivering high pressure air to the center of the table and low pressure air to the peripheral edges, a more uniform distribution of slurry is achieved.

Figure 7:
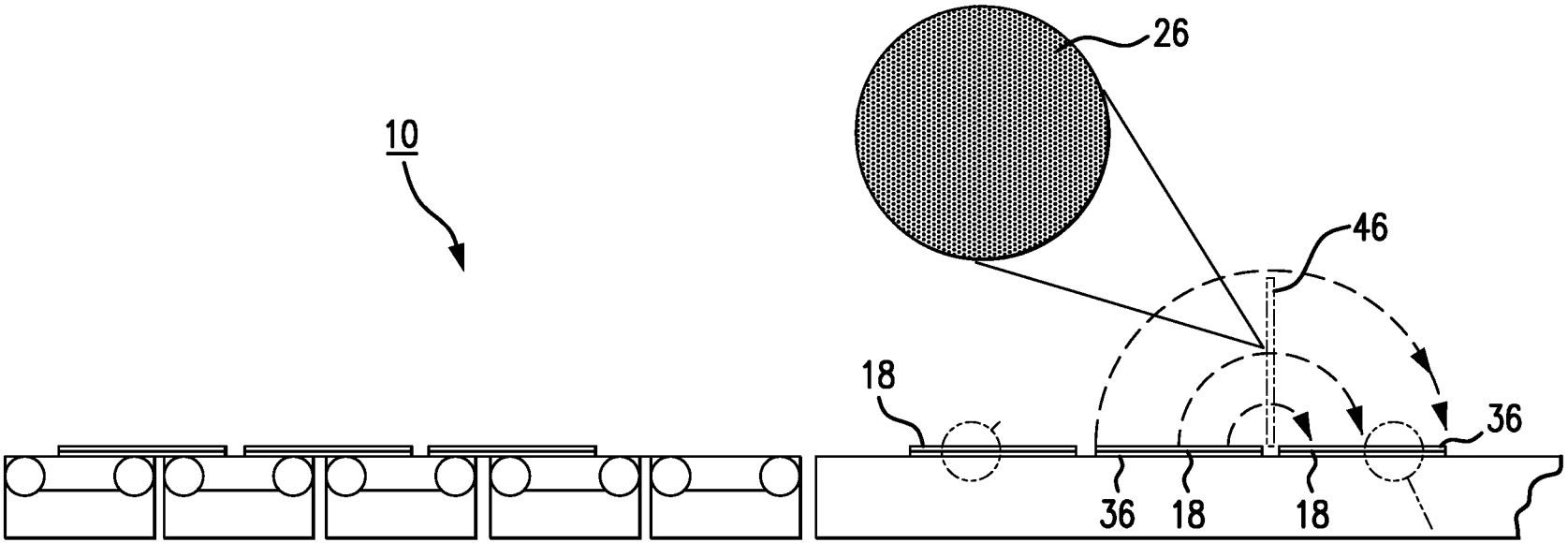
FIG. 7 is a side elevational view of an alternative production line for producing building boards in accordance with the present disclosure. Similar reference characters refer to similar components throughout the several views of the drawings.

FIG. 7 illustrates flipper arms 46 that are conventionally used along board forming lines. These arms 46 are employed flipping completed board such that the bottom facing sheet 36 becomes exposed. In this embodiment, each of the arms 46 includes nozzles 26 similar to the nozzles formed within the upper surface of the forming tables 20. The nozzles 26 are connected to a source of pressurized air 32. This embodiment, allows an air cushion to be formed between the flipper arms 46 and the completed board 18. This embodiment has the advantage that the boards 18 are not damaged or marred while by being flipped.

In a further aspect of the invention, the air provided by the air sources 32 can be heated. Thus, in addition to providing a lifting or propelling force to the boards, the supplied air can serve to further dry the boards. This would reduce the drying otherwise required by traditional board dryers. If the heated air is sufficient, heated air source 32 could altogether eliminate the need for external board dryers. This would represent a vast improvement by removing the opportunity for edge damage and paper, ply delamination associated with traditional drying mechanisms.

The air lift forming tables described above can be used throughout the entire wet forming process of the board as an alternative to the traditional post extruder forming belts. It is also within the scope of the present invention to utilize air lift forming tables in transfer or booking/staging areas within a board plant. These areas are known to cause surface damage to boards. Hence, by utilizing the air lift tables described herein, the damage or marring of completed boards can be avoided.

Although this disclosure has been described in terms of certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure.

What is claimed is:

1. A method for producing building boards, the method comprising:

unwinding a facing sheet from a supply roll of facing sheet over top of a forming table that includes a series of nozzles;

depositing a volume of cementitious material from a slurry mixing device to the unwound facing sheet; and supplying pressurized air from an air source to the series of nozzles, whereby a cushion of air is created between the unwound facing sheet and the forming table, wherein the air source supplies pressurized air in bursts at a set frequency.

2. The method of claim 1, further comprising vibrating the deposited cementitious material via the pressurized air bursts.

3. The method of claim 1, wherein the nozzles are angled and the method further comprises moving the unwound facing sheet via the cushion of air.

4. The method of claim 1, further comprising supplying the pressurized air at greater pressures at select locations upon the forming table so as to promote a distribution of the deposited cementitious material.

5. The method of claim 1, wherein the nozzles are angled so as to impart directional movement to the facing sheet.

6. The method of claim 1, wherein the nozzles are evenly distributed across a length and width of the forming table.

7. The method of claim 1, wherein each nozzle includes a longitudinal axis that is perpendicular to an upper surface of the forming table.

8. The method of claim 1, wherein the forming table includes a longitudinal axis bisecting the forming table into first and second halves and wherein the nozzles within the first and second halves are orientated at opposite angles.

9. The method of claim 1, wherein the forming table includes a longitudinal axis and peripheral edges and wherein the air source supplies air at a greater pressure proximate the longitudinal axis and air at a lesser pressure proximate the peripheral edges.

10. A method of making a building board, the method comprising:

unwinding a supply roll of bottom facing sheet material made of paper or a fibrous mat onto an upper surface of a forming table, the upper surface having a plurality of nozzles formed therein;

depositing a gypsum slurry onto the bottom facing sheet material on the forming table; and supplying pressurized air to the plurality of nozzles through a plenum in fluid communication with the plurality of nozzles, wherein the pressurized air creates a cushion of air between the upper surface of the forming table and the bottom facing sheet material on the forming table, wherein the plenum receives the pressurized air from an air source, and wherein the air source supplies pressurized air in bursts at a set frequency so as to vibrate the deposited gypsum slurry via the pressurized air bursts.

11. The method of claim 10, wherein the nozzles are angled and the method further comprises moving the flexible bottom facing sheet material via the cushion of air.

12. The method of claim 10, further comprising supplying the pressurized air at greater pressures at selected locations upon the forming table so as to promote a distribution of the deposited gypsum slurry.

13. The method of claim 10, wherein the nozzles are angled so as to impart directional movement to the bottom facing sheet material.

14. The method of claim 10, wherein the nozzles are evenly distributed across a length and width of the forming table.

15. The method of claim 10, wherein each nozzle includes a longitudinal axis that is perpendicular to an upper surface of the forming table.

16. The method of claim 10, wherein the forming table includes a longitudinal axis and peripheral edges and wherein the plenum supplies pressurized air at greater pressure proximate the longitudinal axis and pressurized air at a lesser pressure proximate the peripheral edges.

* * * * *